United States Patent [19]

Harper

[11] Patent Number: 4,926,157

[45] Date of Patent: May 15, 1990

[54] CIRCUIT BREAKER

[75] Inventor: George S. Harper, Cambridge, Md.

[73] Assignee: Airpax, Cambridge, Md.

[21] Appl. No.: 189,790

[22] Filed: May 3, 1988

Related U.S. Application Data

[62] Division of Ser. No. 848,169, May 22, 1986, which is a division of Ser. No. 486,716, Apr. 20, 1983, abandoned.

[51] Int. Cl.[5] ..... H01H 9/00

[52] U.S. Cl. ..... 335/172; 335/35

[58] Field of Search ..... 335/6, 8–10, 335/21, 22, 23, 35, 172, 202; 200/293, 293.1, 294

[56] References Cited

U.S. PATENT DOCUMENTS

| | | | |
|---|---|---|---|
| 203,271 | 12/1965 | Camp . | |
| 2,889,428 | 6/1959 | Kingdom et al. . | |
| 2,958,751 | 11/1960 | Camp . | |
| 2,996,589 | 8/1961 | Myers . | |
| 3,069,517 | 12/1962 | Cole . | |
| 3,098,911 | 7/1963 | Schwartz et al. . | |
| 3,098,912 | 7/1963 | Sprague . | |
| 3,179,798 | 4/1965 | Koval et al. . | |
| 3,251,232 | 5/1966 | Harper . | |
| 3,329,793 | 7/1967 | Camp . | |
| 3,329,913 | 7/1967 | Camp . | |
| 3,422,235 | 1/1969 | Camp . | |
| 3,444,488 | 5/1969 | Harper . | |
| 3,486,140 | 12/1969 | Harper . | |
| 3,497,838 | 2/1970 | Merriken et al. . | |
| 3,626,338 | 12/1971 | Nicol et al. . | |
| 3,749,873 | 7/1973 | Harper et al. . | |
| 3,786,380 | 1/1974 | Harper . | |
| 3,786,382 | 1/1974 | Powell | 335/22 |
| 3,806,848 | 4/1974 | Harper et al. . | |
| 3,959,755 | 5/1976 | Harper et al. . | |
| 4,062,052 | 12/1977 | Harper et al. . | |
| 4,117,285 | 9/1978 | Harper . | |
| 4,197,519 | 4/1980 | Grenier | 335/21 |
| 4,266,209 | 5/1981 | DiMarco et al. . | |
| 4,389,555 | 6/1983 | Guinan . | |

FOREIGN PATENT DOCUMENTS

| | | |
|---|---|---|
| 1146606 | 11/1957 | France . |
| 1072558 | 6/1967 | United Kingdom . |

*Primary Examiner*—Leo P. Picard
*Assistant Examiner*—Lincoln Donovan
*Attorney, Agent, or Firm*—Saidman, Sterne, Kessler & Goldstein

[57] ABSTRACT

A circuit breaker is constructed to maximize the range of current over which it may operate, and to enhance its safety of operation in both single-pole and multipole embodiments. The operating mechanism for both manual and automatic modes of operation in single-pole or multipole embodiments of the circuit breaker is improved.

16 Claims, 5 Drawing Sheets

FIG. 12A
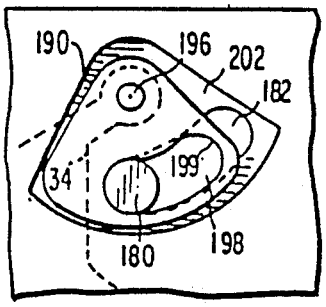
FIG. 12B
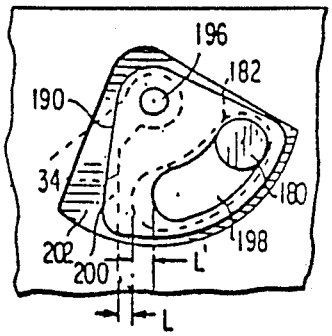
FIG. 13A
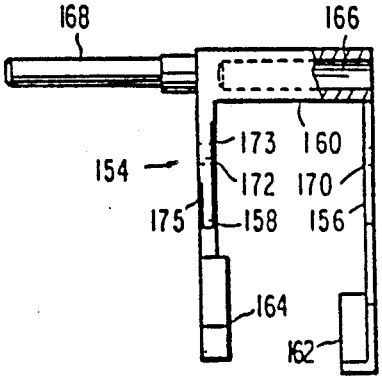
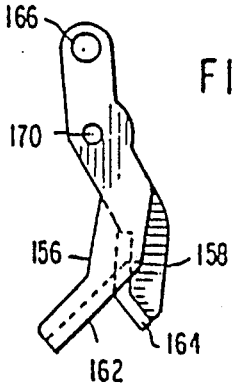
FIG. 13B
FIG. 15A
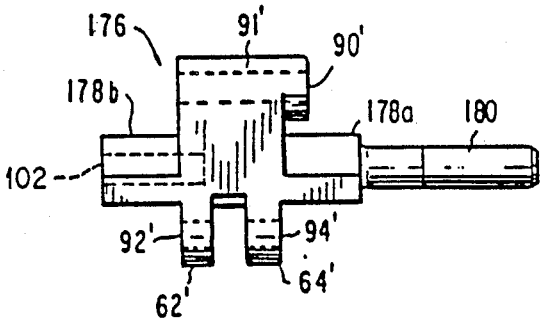
FIG. 15B
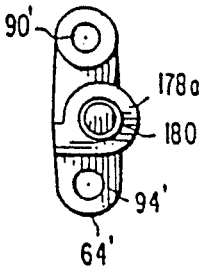

CIRCUIT BREAKER

RELATED APPLICATIONS

This is a division of co-pending U.S. Patent Application Ser. No. 848,169, filed May 22, 1986, which is a division of U.S. Patent Application Ser. No. 486,716, filed Apr. 20, 1983, now abandoned.

BACKGROUND OF THE INVENTION

1.Field of the Invention

The present invention concerns single-pole and multipole electrical circuit breakers in which maximum contact opening is achieved in a circuit breaker of minimum size. The present invention includes means affording maximum accuracy in control of the switching means, as well as improved safety.

2. Discussion of the Related Art

Commonly assigned U.S. Pat. Nos. 3,959,755 to Harper et al. and U.S. Pat. No. 4,117,285 to Harper disclose representative conventional circuit breakers, comprising a stationary electrical contact, a movable electrical contact mounted on a movable contact arm, means for manually opening and closing the contacts, and means for automatically opening the contacts in response to an overcurrent through the breaker. The component parts of the breaker are enclosed in an insulating plastic housing.

Commercial circuit breaker manufacturers generally manufacture a complete product line composed of a number of breaker sizes, each one covering a different (although sometimes overlapping) operating current range. To date, each breaker size has required its own component and case sizes. In general, each component and case size combination is useful in circuits having only a single current rating range. The need to have a different set of component and case sizes for each current rating has added to the overall cost of breakers of this general type. Heretofore, a variety of factors has dictated breaker One such factor relates to the minimum gap requirement between contacts that must be met for a given current rating, when the breaker contacts are manually opened, as well as when they are tripped open automatically. (Many breakers separate their contacts a first distance when manually opened and a different distance when automatically tripped.) It is necessary to make the breaker sufficiently large so that the minimum gap requirement is met in the manual and automatic modes, whichever results in a smaller gap. This requirement has an effect on the overall size of the breaker.

As the current carrying capacity (or rating) of the breaker increases, the gap between the electrical contacts of the breaker in the OFF (or open) position must increase proportionately. Since known circuit breakers are generally capable of separating their electrical contacts only a relatively limited distance compared to the overall size of the breaker, it has been necessary to manufacture increasingly larger circuit breakers in order to obtain the greater spacing between electrical contacts in the OFF position required for higher current ratings.

The overall dimensions of circuit breakers are also determined in part by the need to satisfy industry safety standards. Industry standards, such as the German VDE and the proposed IEC standard, for example, typically require that the plastic casing of the breaker be designed to prevent access by external objects such as a human finger, to within a given distance of electrically conductive parts of the breaker. When breakers are employed in a multipole arrangement, it is also required that a specified distance be maintained between conductive parts of adjacent breaker poles.

Multipole circuit breakers typically comprise several interconnected single-pole units positioned adjacent each other. The manual switching handles of the respective breakers may be connected to each other for simultaneous manual actuation of all poles. Alternatively, or in addition to connecting the respective manual switching handles, means may be provided to trip open automatically all of the breaker poles simultaneously when any one of them is tripped.

Conventional multipole circuit breaker arrangements include a trip lever mechanism associated with each pole of the multipole circuit breaker. Each trip lever includes a portion for joining it to adjacent trip levers. If any pole is tripped open by an overcurrent, the breaker mechanism of that pole causes the trip lever to pivot about its mounting axis. The pivotal motion of one lever causes all the interconnected trip levers to similarly pivot. Each lever may include an arm for striking the armature or toggle mechanism of its respective pole, and causing each pole to be tripped open.

This apparatus, while generally satisfactory, suffers from certain drawbacks. Upon automatic tripping of a first pole, a rather lengthy series of mechanical movements must take place in order to trip each breaker pole. The tripped pole must impart pivotal movement to its associated trip lever; that trip lever must impart similar motion to the other trip levers to which it is joined. Each trip lever must contact the armature of its associated pole; and the armatures must trip open each respective pole. In known breakers, a pin and socket or similar arrangement is used for joining several trip levers to each other. Due to manufacturing tolerances, the fit between levers is likely to be somewhat loose, and the motion of some levers will generally lag behind that of other levers by as much as several thousandths of an inch. The effect of such mechanical delays multiplies as the number of poles increases. These mechanical delays cause temporal delays in breaker tripping; ultimately this can result in damage to the circuit intended to be protected. Ideally, therefore, tripping of all poles should occur virtually simultaneously upon tripping of any one pole.

In another known arrangement, a rotatable trip bar extends through each pole of the multipole breaker. When a pole is tripped, the bar rotates to trip open the remaining poles. While this device does not suffer from backlash delays caused by the above-described loose-fitting pin joining means, it is still necessary for the device to execute a lengthy sequence of mechanical movements in order to trip open all of the breakers. The first tripped breaker must strike its associated trip lever; the trip lever must strike a tab of the rotatable trip bar. The remaining tabs of the trip bar must contact the armatures of the remaining breakers; and the armatures must strike the automatic tripping means of each breaker.

Additionally, it is conventional practice to join the manual switching handles of a multipole circuit breaker by inserting a pin through a hole in each of the several handles. Manufacturing tolerances result in a somewhat loose fit of the pin within each handle. Some of the handles will therefore lag behind others when all are moved together to open or close all of the poles. Consequently, the electrical contacts of the several poles will not open or close at precisely the same time.

An additional drawback of the manual switching means associated with many known circuit breakers is the relatively long motion required to move the switching handle between the ON and OFF positions. As the length of the handle "throw" increases, the time required to manually open the breaker also increases. Although measured in small fractions of a second, such time differences are significant when rapid interruption of an electrical circuit is necessary. This problem is compounded by the backlash and delay resulting from the loose fitting pin typically joining the handles of a multipole circuit breaker. A desirable reduction in the "throw" between the ON and OFF positions of the handle is generally accompanied by an undesirable reduction in the maximum separation between electrical contacts of the circuit breaker in the OFF position.

The present invention is directed, in part, to overcoming the above-mentioned problems associated with known circuit breakers.

SUMMARY OF THE INVENTION

In one of its aspects, the invention includes a circuit breaker having a non-conductive casing and a non-conductive handle for manually operating the breaker. Cooperating portions of the handle and casing define a nonlinear gap between external portions of the handle and casing and electrically conductive portions of the breaker within the casing. The actual distance (or shortest spark path) between external parts of the casing in the vicinity of the handle, through the nonlinear gap to electrically conductive parts of the breaker is at least 0.315 inch (8 millimeters) while the linear distance (measured through interposed structures) between the accessible portion and the conductive parts is substantially less than that dimension.

The configurations of the cooperating portions of the casing and handle, respectively, are such that, while these portions define the nonlinear gap, movement of the handle is unimpeded. In the preferred embodiment, the handle and casing define arcuate ridges which permit pivotal movement of the handle while defining a tortuous path or gap.

In another of its aspects, the invention includes an improved trip lever for multipole circuit breakers. The improved trip lever is advantageously used in a multipole breaker wherein each single-pole breaker includes a toggle mechanism and means for releasing the toggle to open the breaker. Each lever includes two legs joined for pivotal movement and a portion for joining each lever to similar levers of adjacent single-pole breakers, whereby all the levers will pivot simultaneously. One leg of each lever is positioned to be engaged by a portion of its respective circuit breaker when that breaker is tripped open, imparting pivotal movement to all of the joined levers. The second leg of each lever then engages the toggle release means, thereby tripping open the remaining breakers.

Each trip lever includes an improved portion which is adapted to join the lever with similar levers of adjacent single-pole breakers. Each lever includes a tapered extension and a tapered aperture. The extension passes through aligned openings in adjacent circuit breaker casings and is received within the tapered aperture of an adjacent lever. The tapers in the aperture and extension, respectively, permit the extension to be easily inserted yet snugly seated within the aperture, eliminating the loose fit and backlash associated with previously known devices.

The invention also includes improved means for manually operating all breakers of a multipole circuit breaker. Each breaker includes a manual switching part within its respective casing, such part having a portion adapted to mate with similar switching parts of adjacent breakers. At least one of the breakers also includes a portion of the manual switching part extending outwardly from the casing and forming a handle.

The casing of each breaker which includes an outwardly extending handle includes an opening through which the handle extends. The casings of the remaining breakers of the multipole breaker are imperforate in the region of the manual switching part. The mating portions of the switching parts include slightly tapered projections, or extensions, that pass through openings in the casings of adjacent breakers. These join the respective manual switching parts for joint movements without backlash and its attendant disadvantages. Preferably, in order to avoid mechanical lag time problems as discussed above, only a maximum of four breakers should be so linked in a multipole assembly.

The preferred embodiment of the invention includes a thickened casing wall portion around the opening through which the manual switching part extends. With this casing configuration, the distance that a spark must travel from an internal conductive element to the outside exceeds the industry minimum requirement because of the tortuous path that such a spark must travel This configuration therefore satisfies such industry standards as the German VDE standard.

The invention may alternatively include a shield which at least partially covers each opening through which a tapered extension of a manual switching part passes. In this embodiment, the shield is mounted in a recess defined by exterior portions of adjacent circuit breaker casings and is movable in response to movement of the manual switching means. The shield defines a deviated path between interior portions of adjacent breakers The distance along the deviated path between electrically conductive parts of adjacent breakers is at least 0.315 inch (8 mm) while the linear distance between the conductive parts is substantially less than that dimension. The tapered extension passing between breakers is, of course, nonconductive.

Each pole of a multipole circuit breaker in accordance with the alternative embodiment of this invention includes a casing in which at least one wall contains a recess. The recesses of adjacent walls together define a space for mounting the aforesaid movable shield.

A circuit breaker in accordance with the invention includes a handle which is pivotally mounted and pivotally connected to a first toggle link. The first link is pivotally connected to a second toggle link, which is in turn pivotally connected to a movable contact arm. The aforesaid pivotable mounting and pivotal connections are in substantial alignment with each other when the circuit breaker is in the ON (or closed) position. This alignment minimizes the forces acting on that portion of the circuit breaker which maintains the toggle links in extended condition in the ON position. Consequently, minimal force is required to automatically trip the breaker and sensitivity of the breaker is increased.

The movable contact arm is pivotally mounted to a stationary part of the breaker. The latter pivotal mounting, together with the pivotal connection between the contact arm and the second toggle link, defines a line which is substantially perpendicular to the line along which the remaining pivotal connections lie. In accordance with the invention, the various pivotal connections, arranged in the described fashion, are spaced from each other at distances satisfying particular proportional relationships. This arrangement permits the same essential mechanism to be used for breakers of several different current rating ranges.

The above-described features and advantages are best understood in view of the subsequent description of the preferred embodiment of the present invention, and in view of the accompanying drawings.

BRIEF DESCRIPTION OF THE DRAWINGS

FIGS. 6A–6C are side, top and end views, respectively, of a movable contact arm in accordance with the present invention;

FIG. 12A and 12B illustrate a shield employed in multipole circuit breakers of the present invention;

FIGS. 13A and 13B show end and side views, respectively, of a trip lever in accordance with the invention;

FIGS. 15A and 15B are side and end views, respectively, of a handle link of the invention;

DESCRIPTION OF THE PREFERRED EMBODIMENT

Figure 2:
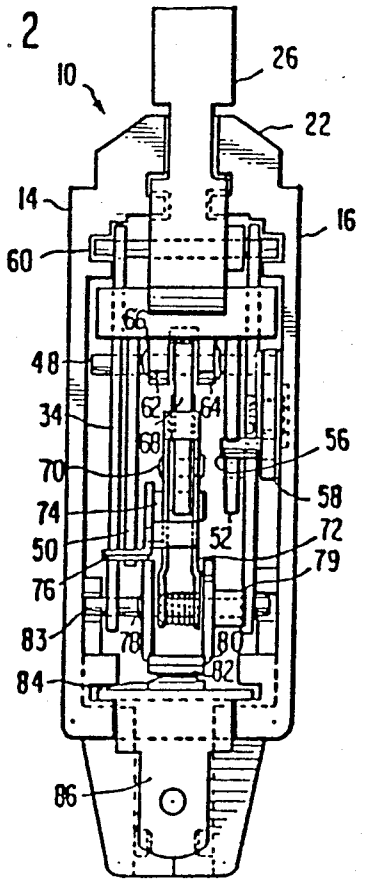
FIG. 2 is an end view of the circuit breaker of the present invention.
Figure 1:
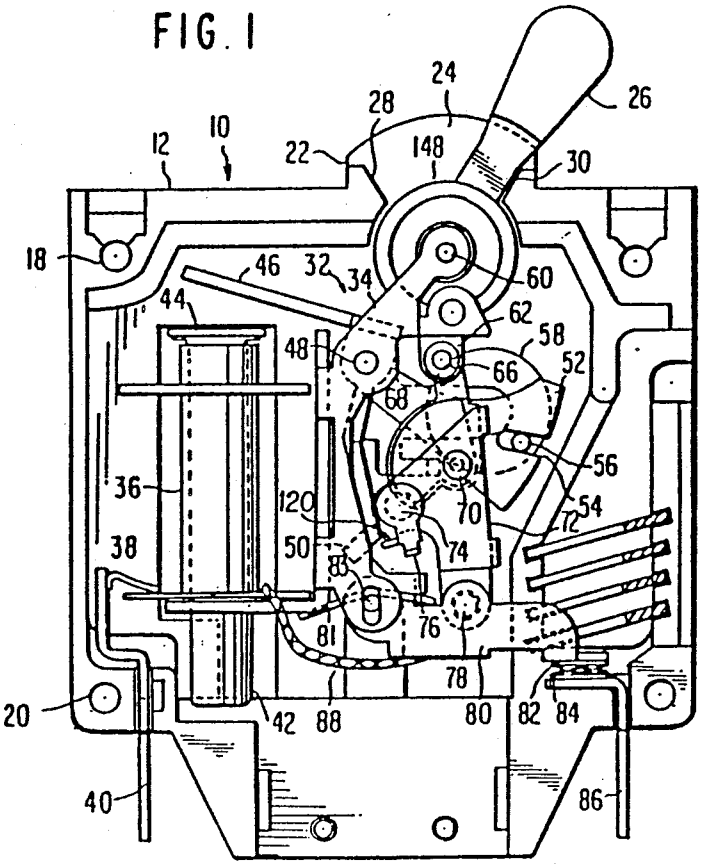
FIG. 1 is a side view of a circuit breaker in accordance with the present invention.

Referring to FIGS. 1–2, a preferred embodiment of a circuit breaker in accordance with the present invention is designated generally by reference numeral 10. The circuit breaker includes a case 12 formed of electrically insulating material, such as plastic. Case 12 is formed from a pair of complementary casing halves 14 and 16, which are secured together by rivets or similar fasteners (not shown) through a plurality of upper and lower fastener holes 18 and 20.

A boss 22 extends from the upper portion of case 12 and includes an opening 24 for a toggle handle 26. Handle 26 is also formed from a non-conductive material, typically molded plastic. A pair of surfaces 28 and 30 within opening 24 limit pivotal movement of handle 26.

The trip mechanism is designated generally by reference numeral 32. It includes a one-piece frame 34 which is fixedly mounted within case 12. Frame 34, described in more detail below with reference to FIG. 7C, supports an overcurrent trip coil 36, which is connected through an electrical lead 38 to a terminal 40.

Coil 36 surrounds a magnetic core 42. Preferably, although it does not form an essential part of the present invention, core 42 includes a delay tube. By way of example only, the coil and delay tube assembly may be of the type shown and described in commonly assigned U.S. Pat. No. 4,062,052 to Harper et al., the disclosure of which is incorporated herein in its entirety by reference.

Magnetic core 42 terminates in a pole piece 44. Adjacent pole piece 44 is an armature 46 pivotally mounted on a pin 48 secured to frame 34. Armature 46 is rotatably biased in a clockwise direction (relative to FIG. 1) by a spring (not shown), and comprises a leg 50 and a counterweight 52. Counterweight 52 comprises an enlarged extension of armature 46, and may include a slot 54 for receiving a pin 56 of an inertia wheel 58 rotatably mounted on frame 34. The function of the inertia wheel is set forth in detail in commonly as signed U.S. Pat. No. 3,497,838 to Merriken et al., the disclosure of which is incorporated herein in its entirety by reference.

Handle 26 is pivotally mounted on a pin 60 secured in frame 34. Handle 26 includes a pair of ears 62 and 64 with apertures for receiving a rivet or pin 66 which connects handle 26 to a cam link 68. Cam link 68 is pivotally connected by a rivet or pin 70 to a housing link 72. A sear pin 74, as is well known in the art, is rotatably mounted in housing link 72 and is biased in a clockwise direction by spring means (not shown) A sear striker bar 76 is secured to sear pin 74.

A rivet or pin 78 pivotally attaches housing link 72 to a movable contact arm 80. Arm 80 is pivotally mounted on a pin 83 secured to frame 34 and is biased in a counterclockwise direction by a spring 81. In the embodiment shown, arm 80 is also slidably mounted on pivot pin 83. Contact arm 80 carries on the end thereof a movable contact 82 which is held, when the breaker is in the closed, or ON, position, against a stationary contact 84 mounted on terminal 86. The circuit breaker is connected by terminals 40 and 86 into an electrical circuit, as is well known.

Coil 36 is electrically connected to contact arm 80 by a conductive braid 88. When the breaker is closed, a continuous electrical path is created through terminal 40, lead 38, coil 36, braid 88, contact arm 80, contacts 82 and 84, and terminal 86.

Figure 3B:
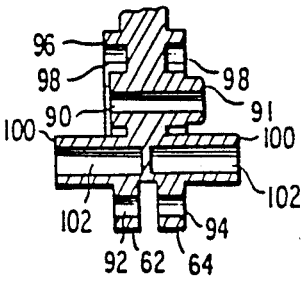
FIG. 3B is a partial sectional view along line B—B of FIG. 3A.
Figure 3A:
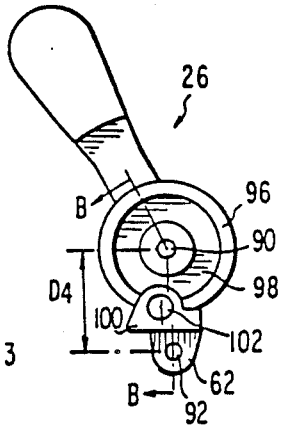
FIG. 3A is a side view of an operating handle for the circuit breaker in accordance with the invention.

With reference to FIGS. 3A and 3B, handle 26 has a central opening 90 in a hub 91 for pivotally mounting handle 26 on pin 60. A pair of apertures 92 and 94 in ears 62 and 64 receive rivet 66, as described above.

Concentrically disposed with respect to opening 90 are a pair of arcuate ridges 96 and a pair of arcuate recesses 98. A pair of lateral protrusions 100 extends from opposite sides of handle 26, each protrusion having an aperture 102 therein. As seen in FIG. 3A, the center-to-center distance from the pivot axis of handle 26 to the center of apertures 92 and 94 where the handle is joined to cam link 68 is represented by a dimension $D_4$.

Figure 4:
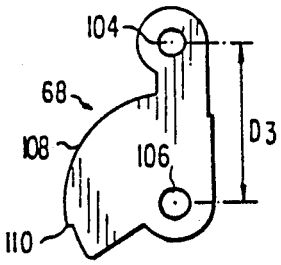
FIG. 4 is a side view of the toggle mechanism cam link of the invention.

Referring to FIG. 4, cam link 68 includes an upper pivot opening 104 which receives rivet 66 connecting link 68 to handle 26. A lower pivot opening 106 receives rivet 70, connecting link 68 to housing link 72. A cam surface 108 includes a seat 110 against which sear pin 74 rests to lock links 66 and 72 of the toggle mechanism against relative movement. The distance between the centers of the upper and lower pivot openings 104 and 106 is represented by a dimension $D_3$.

Figure 5A:
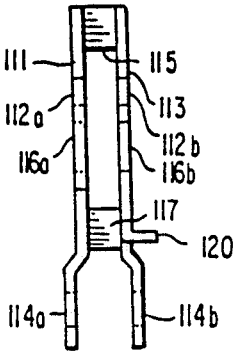
FIGS. 5A and 5B are end and side views, respectively, of the toggle mechanism housing link in accordance with the invention.
Figure 5B:
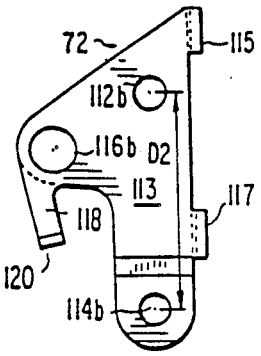

Referring to FIGS. 5A and 5B, housing link 72 includes a pair of spaced parallel plates 111 and 113 joined by a pair of upper and lower straps 115 and 117. Plates 111 and 113 each have an upper pivot opening 112*a* and 112*b* respectively, to receive rivet 70, and pivotally connect link 72 to link 68. Plates 111 and 113 also have a lower pivot opening 114*a* and 114*b*, respectively, for receiving rivet 78, to pivotally connect link 72 to contact arm 80. Sear pin 74 is rotatably mounted within a pair of openings 116*a* and 116*b* respectively, in plates 111 and 113.

The rightmost plate 113, as seen in FIG. 5A, has an extension 118 which includes a tab 120 projecting laterally outward of housing link 72. Tab 120 acts as a stop for striker bar 76 of sear pin 74, as best seen in FIG. 1. The distance between the centers of the upper and lower pivot openings 112 and 114 is represented by dimension $D_2$.

Figure 6A:
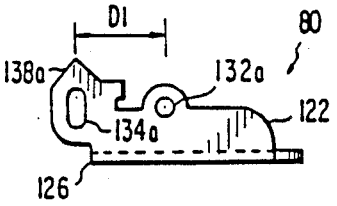
Figure 6B:
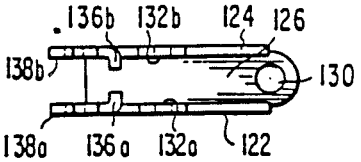
Figure 6B:
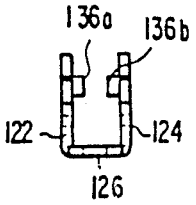

As illustrated in FIGS. 6A–6C, movable contact arm 80 includes a pair of sides 122 and 124, connected by a bottom plate 126 End plate 126 has an opening 130 therein for mounting movable contact 82 to arm 80. Sides 122 and 124 have openings 132*a* and 132*b*, respectively, for pivotally connecting arm 80 to housing link 72 by means of rivet 78.

Another pair of openings 134*a* and 134*b* (the latter not shown) in sides 122 and 124, respectively, receives pin 83, for pivotally connecting arm 80 to frame 34. A pair of inwardly projecting stops 136*a* and 136*b* respectively, act as a seat for one end of spring 81. The other end of spring 81 bears against frame 34 (FIG. 1), rotatably biasing arm 80 in a counter clockwise direction. A pair of surfaces 138*a* and 138*b* respectively, is adapted to bear against frame 34 when the circuit breaker is opened, preventing further counterclockwise rotation of contact arm 80 about its pivot axis. The distance between the pivot axis of arm 80 and the axis of the pivotal connection between arm 80 and link 72 (FIG. 6A) is represented by dimension $D_1$.

Figure 7A:
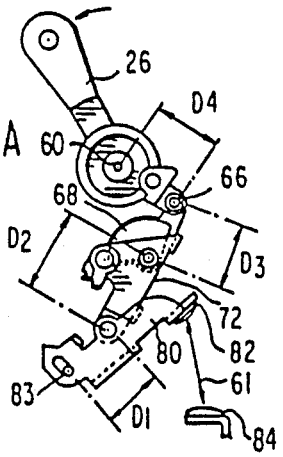
FIG. 7A illustrates the switching means for a circuit breaker in accordance with the present invention in a manually opened condition.
Figure 7B:
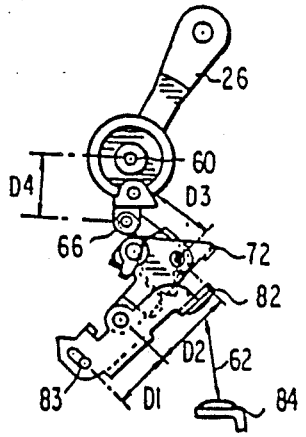
FIG. 7B illustrates the same switching means in a tripped open condition.
Figure 7C:
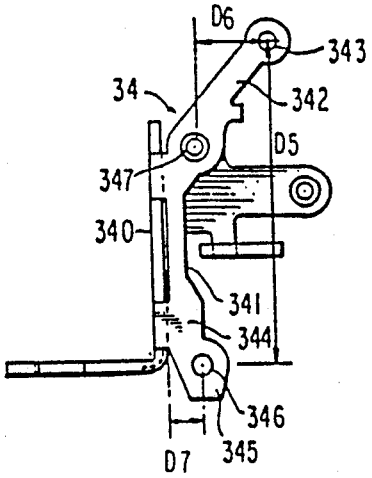
FIG. 7C illustrates the frame for a circuit breaker in accordance with the present invention.

FIG. 7C shows a side view of the frame 34 separately. The frame includes a main body portion which includes an L-shaped back plate 340, on which coil 36 rests, and a pair of side members 341 (only one of which is shown in full in FIG. 7C). Both side members have an upwardly extending arm 342 which terminates in a circular portion containing an opening 343 through which pivot pin 60 passes. Each side member 341 also has a downwardly extending leg 344 which terminates in an end portion 345 having an opening 346 through which pivot pin 83 passes. Both side members 341 also contain openings 347 through which armature pivot pin 48 passes. In operation, when the breaker is opened, contact arm 80 pivots about pin 83 to the point at which surfaces 138*a* and 138*b* strike the front face of L-shaped back plate 340.

A feature of this invention, which permits the same breaker mechanism to be used in breakers of different current ratings, is the dimensional relationship of the frame elements to each other. The height or vertical distance between the centers of pivot pin openings 343 and 346 is represented by dimension $D_5$. The lateral distance between pin opening 343 and pivot pin opening 346 is represented by dimension $D_6$. Dimensions $D_5$ and $D_6$ represent two legs of a right triangle, the hypotenuse of which extends between and intersects the centers of pivot pin openings 343 and 346. The lateral distance between the pivot pin opening 346 and a plane containing the face of back plate 340 and extending parallel to the right triangle leg defined by dimension $D_5$, is represented by dimension $D_7$. Surfaces 138*a* and 138*b* of contact member 80 abut against the face of back plate 340 of frame 34 to terminate the counterclockwise rotation of contact arm 80.

For purposes of the following discussion, the axis of pin 83, pivotally connecting contact arm 80 to frame 34, will be designated the first pivot axis; the axis of rivet 78, pivotally connecting housing link 72 with contact arm 80, will be designated the second pivot axis; the axis of rivet 70, pivotally connecting cam link 68 with housing link 72, will be designated the third pivot axis; the axis of rivet 66, pivotally linking handle 26 with cam link 68, will be designated the fourth pivot axis; and the pivot axis of handle 26 (through pin 60) will be designated the fifth pivot axis.

When the breaker 10 is in its closed, or ON position, the second, third and fifth pivot axes lie substantially along an imaginary straight line between the second axis at rivet 78 and the fifth axis at pin 60. The fourth pivot axis is slightly offset from that imaginary line (to the left as shown in FIG. 1). Spring 81 biases contact arm 80 in a counterclockwise direction. This in turn biases the toggle mechanism comprising links 68 and 72 toward a collapsed position. In the absence of a sear pin 74, this would cause contact arm 80 to rotate, thereby opening the breaker. In the ON, or closed position shown in FIG. 1, sear pin 74 bears against seat 110 (see FIG. 4) of cam link 68, maintaining the toggle mechanism in its extended condition.

Sear pin 74 must be rotated in a counterclockwise direction, in a manner described in greater detail hereinafter, in order to trip open the circuit breaker. The arrangement of the present invention, in which the several pivot axes are aligned as indicated, minimizes the forces acting between sear pin 74 and seat 110, thus maximizing sensitivity of the device. Otherwise, inordinately large forces would act between sear pin 74 and seat 110. A substantial force would be required to rotate the sear pin and trip the breaker, reducing its sensitivity.

While it has been indicated that the second, third and fifth pivot axes lie substantially along a straight line extending between the second and fifth axes, it is well known in the art that, if the second, third and fourth axes are in perfect alignment, the spring bias force acting on the toggle mechanism through contact arm 80 will not collapse the toggle when the circuit breaker is tripped. Therefore, the third pivot axis at rivet 70 must be offset slightly with respect to a line extending between the second axis at rivet 78 and the fourth axis at rivet 66. This offset is very slight, only to a degree sufficient to assure collapse of the toggle mechanism. Substantial alignment of the second through fourth axes results in a reduction in the forces acting between sear pin 74 and seat 110 and increases the sensitivity of the breaker.

It is also necessary to displace the fourth axis at rivet 66 slightly with respect to a line between the second and fifth axes to assure that, under the influence of spring 81, handle 26, and thus the breaker mechanism in its entirety, will remain closed or ON once positioned as shown in FIG. 1. Again, this offset is only to the minimum degree necessary to assure stability of the breaker in the ON position. Thus all of the second through fifth axes are considered to be substantially aligned.

In operation, when current through the circuit breaker exceeds a predetermined threshold, the strength of the magnetic field generated by coil 36 will be sufficient to attract armature 46 toward pole piece 44. As armature 46 pivots about pin 48, leg 50 contacts sear striker bar 76, rotating sear pin 74 in a counterclockwise direction. Rotation of sear pin 74 disengages the pin from seat 110 of cam link 68. In the absence of the restraint imposed by sear pin 74, the toggle mechanism comprising links 68 and 72 is free to collapse, allowing contact arm 80 to pivot in a counterclockwise direction under the influence of spring 81. Contacts 82 and 84 thereby separate, and the circuit through the breaker 10 is interrupted.

The circuit may also be interrupted manually. If handle 26 is pivoted in a counterclockwise direction about the pivot axis at pin 60, rivet 66 securing cam link 68 to handle 26 orbits or rotates about pin 60 in a counterclockwise direction. Sear pin 74 remains engaged with seat 110 and links 68 and 72 remain locked in place, as shown in FIGS. 1 and 7A. As rivet 66 traverses an arc centered on the axis of pin 60, links 68 and 72 are raised and rotated, as illustrated in FIG. 7A. Rivet 78, joining housing link 72 and contact arm 80, moves upwardly and traverses an arc centered on the axis of pin 83. This results in movement of contact arm 80, separating contacts 82 and 84, and interrupting the circuit through the breaker.

Unique results may be obtained from a circuit breaker when specific relationships are established between the various elements of the breaker operatively arranged as described above. As discussed earlier, it is necessary to maintain a minimum gap clearance for a given amperage rating in a circuit breaker. The gap must be made larger as the amperage rating increases. However, it is not necessary to increase overall size, as compared to known circuit breakers, in order to widen the air gap between the electrical contacts when the breaker is in the open condition. The particular relationships, referenced above and discussed below, will maximize the gap between the open breaker contacts within given dimensional restraints in both the manually opened and automatically tripped modes of operation. Therefore, circuit breakers of relatively small overall dimensions may be manufactured for use at relatively high amperages and over a broad range of amperage ratings. Furthermore, the preferred spatial relationships between the components of the present invention afford the unique result that contact arms of various sizes and current ratings may be interchanged and still function properly with the same toggle mechanism.

In accordance with the invention, the above-defined dimensions $D_1$–$D_7$ are maintained in particular relationships to each other in order to achieve uniquely advantageous results. Handle 26, cam link 68, housing link 72 and contact arm 80 are formed in such manner as to establish the desired relationships.

FIGS. 7A and 7B illustrate the switching means of the present invention in manually opened and tripped open condition, respectively. When opened manually, handle 26 is rotated in a counterclockwise direction about the pivot axis at pin 60, as indicated in FIG. 7A. When handle 26 is in its extreme counterclockwise position, as defined by surface 28 of case 12 (FIG. 1), a gap $G_1$ is established between contacts 82 and 84. FIG. 7B illustrates the circuit breaker of the invention in tripped open condition. When the breaker is tripped, contacts 82 and 84 separate a distance defined by gap $G_2$. Gaps $G_1$ and $G_2$ are maximized in a circuit breaker of given dimensions when dimensions $D_1$, $D_2$, $D_3$, $D_4$, $D_5$, $D_6$ and $D_7$ have the following relationships:

$$D_3{:}D_1 < D_4{:}D_1 < D_2{:}D_1;$$

$$D_7{:}D_1 < D_6{:}D_1 < D_3{:}D_1 < D_4{:}D_1 < D_2{:}D_1 < D_5{:}D_1; \text{ and}$$

$$D_7{:}D_5 < D_6{:}D_5$$

When the above-described relationship is maintained among distances $D_1$, $D_2$, $D_3$, $D_4$, $D_5$, $D_6$ and $D_7$, gap size $G_1$ *is maximized, not only with respect to the overall dimensions of the circuit breaker, but also with respect to the degree of travel of handle* 26. *Compared to known circuit breakers of comparable overall dimensions, gap* $G_1$ is substantially increased while the range of arcuate motion of handle 26 is reduced to approximately 31°–32°; this is substantially less handle travel than is characteristic of known devices. The present device thus constitutes a very fast-acting manual breaker, achieving increased gap distance for smaller movements of the manual control means. The device of the invention will be capable of accommodating an equally wide range of amperage ratings in the manually opened and automatically tripped open modes of operation. Consequently, neither mode of operation limits the range of usefulness of the present invention.

As an example, a device in accordance with the present invention may include parts having the following dimensions: $D_2$=0.430 inch; $D_3$=0.330 inch; $D_4$=0.340 inch; $D_5$=1.093 inch; $D_6$=0.240 inch; $D_7$=0.126 inch; and $D_1$=0.30 inch. In this example,

| |
|---|
| $D_2{:}D_1$ is substantially 1.43:1.00 |
| $D_3{:}D_1$ is substantially 1.10:1.00 |
| $D_4{:}D_1$ is substantially 1.13:1.00 |
| $D_5{:}D_1$ is substantially 3.64:1.00 |
| $D_6{:}D_1$ is substantially 0.80:1.00 |
| $D_7{:}D_1$ is substantially 0.42:1.00 |
| $D_6{:}D_5$ is substantially 0.22:1.00 |
| $D_7{:}D_5$ is substantially 0.12:1.00 |

Gaps $G_1$ and $G_2$ will therefore be maximized at substantially 0.53 inch (13.48 mm). This is sufficient to satisfy industry safety standards, such as German VDE and proposed IEC safety standards, which require only a three millimeter gap between contacts in the OFF or open position. The present invention satisfies these standards in a breaker of minimum dimensions and facilitates use of smaller breakers to satisfy requirements for minimum gap clearances.

The aforesaid industry safety standards also require a separation of at least 8 mm (0.315 inch) between "live" (electrically conductive) parts and accessible portions of the circuit breaker. Accessible portions are defined as those areas of the circuit breaker which may be reached from the exterior of the casing using a 2×4 millimeter probe. The distance is measured as the shortest distance from the accessible portion through a space or across a surface or surfaces leading to live parts. It has generally been necessary to enlarge or extend portions of circuit breakers and/or their casings in order to satisfy this standard. The present invention meets this requirement without enlarging the overall dimensions of the circuit breaker.

A circuit breaker in accordance with the present invention may also be used in multipole arrangements. As exemplified by the aforesaid U.S. Pat. Nos. 3,444,488 and 3,786,380, multipole circuit breakers may comprise a plurality of single pole circuit breakers adjacent each other and operatively connected. The circuit breaker of the present invention includes means adapting it for use in multipole arrangements, while overcoming the previously discussed drawbacks associated with known multipole circuit breakers, and while satisfying industry safety standards.

Specifically, the invention includes manual operating means and casing portions which cooperate to define tortuous paths and thereby provide maximum separation between accessible portions and live parts in a circuit breaker of minimum dimensions. Handle 26 includes arcuate ridges 96 and arcuate recesses 98, as previously described with reference to FIGS. 3A and 3B.

Figure 8:
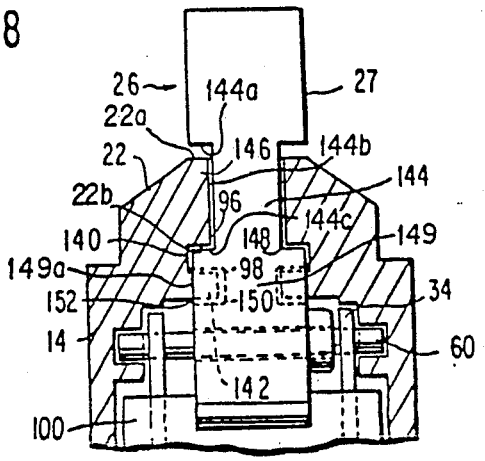
FIG. 8 is a part sectional view of the operating handle mounted in the breaker casing in accordance with the invention.

FIG. 8 shows a portion of the handle and casing of the invention, illustrating the manner in which they provide adequate separation between exterior portions of the circuit breaker and live conductive parts. Handle 26 includes a narrow portion 144 which lies between inwardly extending portions 146 of boss 22 of casing 12. Narrowed portion 144 extends radially inwardly from an enlarged outer portion 27 toward the interior of casing 12 and terminates at ridges 96. Casing halves 14 and 16 in many respects are substantially mirror images of each other. Each casing contains an arcuate recess 140 and an arcuate ridge 142. The arcs of recesses 140 and ridges 142 are centered on the axis of pin 60, pivotally mounting handle 26. Recess 140 and ridge 142 form a non-planar surface portion of each casing half 14 and 16 which is complementary to the non-planar surface portions of handle 26 formed by ridges 96 and recesses 98. The base 148 of narrowed handle portion 144 is at least potentially accessible to the outside of the breaker. The shortest distance from base portion 148 to an electrically conductive, or "live" part within the casing will lie along a tortuous path or air gap 150 which opens into the interior portion of the breaker at a point 152. The tortuous path through gap 150 is substantially longer than the straight line distance from point 148 to the interior of the casing. In a device constructed in the manner and proportions illustrated in FIGS. 3A, 3B and 8, the distance from point 148 through gap 150 to point 152 is about 0.33 inch (8.5 mm); whereas the vertical distance between points 148 and 152 is only about 0.14 inch (3.5 mm).

As shown in FIG. 8, the intermediate portion 144 of the handle 26 is narrower than both the outer handle portion 27 and the inner handle portion 149. A first briding surface **144*a* connects the lateral outer surface 27*a* of the handle portion 27 and the face 144*b* of intermediate portion 144. A second briding surface 144*c* connects the lateral outer surface portion 149*a* of inner handle portion 149 and intermediate face portion 144*b*. These briding surfaces cooperate with adjacent casing surfaces 22*a* and 22*b***, respectively, to define additional parts of the tortuous path between the exterior and interior of the casing.

The arcuate form of ridges and recesses 96, 98, 140 and 142 permits normal pivotal movement of handle 26. The invention is not limited, however, to devices embodying pivotal manual operating means. A device embodying principles of the invention could take the form of, for example, operating means which moves linearly between the OFF and ON positions.

Figure 9A:
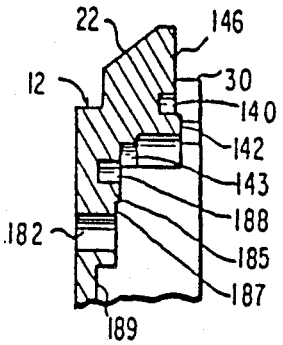
FIG. 9A is a partial sectional view of a portion of the breaker casing in accordance with a multipole embodiment of the invention, taken along line A—A in FIG. 9B.
Figure 9B:
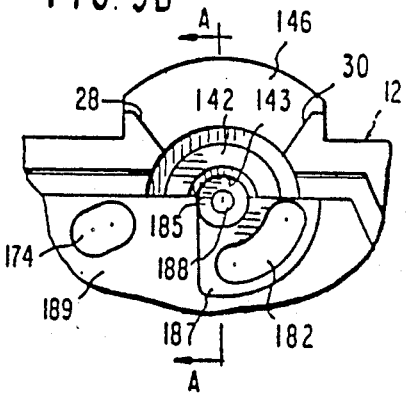
FIG. 9B is a partial side view of the multipole casing in accordance with the invention.

FIGS. 9A and 9B illustrate the preferred embodiment of the casing in accordance with the present invention, having particular utility in multipole configurations. The multipole arrangement requires that one or more connecting links pass through the adjacent casing walls of the several pole units. In order to satisfy industry safety standards, there must be minimum air gap of at least 8 mm (0.315 inch) between the exterior of the case at the side opening and the closest conductive part inside the case. The embodiment shown in FIGS. 9A and 9B incorporates a new design which satisfies this requirement.

The drawing shows one case half; the other case half is substantially the same, except as noted below. Boss 22 extends upwardly from case 12. Wall portion 146 forms the inside wall of boss 22, and, together with the corresponding wall portion of the opposite case half, defines an opening for handle 26. Arcuate recess 140 and arcuate ridge 150 receive arcuate ridge 96 and arcuate recess 98, respectively, as described in detail above. A stepped arcuate recess 143 leads to a recess 188 surrounded by and extending inwardly from a raised surface portion 185 on the interior wall of casing 12 to receive an end of pivot pin 60. An arcuate opening 182 is located in the side wall of casing 12. A connecting member extends through adjacent openings 182 to connect the breaker mechanisms of adjacent pole units. The connecting member is described in more detail below.

It is a feature of this invention that the interior casing wall portion in the region of opening 182 is built up relative to the remaining wall portion. In this way the most direct path between the exterior of the breaker and the closest "live" part will equal or exceed the requisite 8 mm minimum distance. In particular, a wall segment 187 extends outwardly from the main interior wall 189. The arc path created by this outwardly extending wall segment is substantially longer than the arc path that would be created absent such segment 187.

Figure 10A:
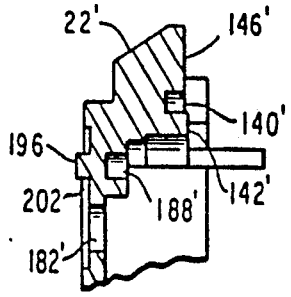
FIG. 10A is a sectional view of an alternate multipole casing of the invention, taken along line 2A—A of FIG. 10B.
Figure 10B:
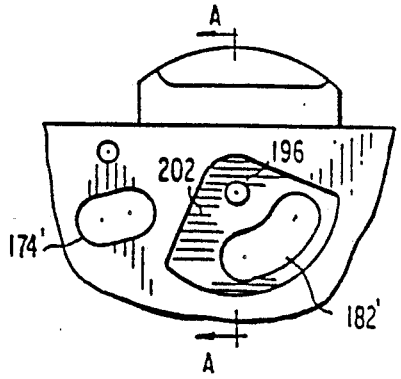
FIG. 10B is a partial side view of the alternate multipole casing configuration of FIG. 10A.

An alternate arrangement, which utilizes an external mounted shield member rather than a built up interior wall segment, is shown in FIGS. 10A–10B. FIGS. 10A–10B illustrate a "right" casing half. A "left" casing half is substantially a mirror image of that shown in the Figures. In this embodiment, the casing includes a portion forming boss 22', an inner face portion 146', an arcuate recess 140' and an arcuate ridge 142', all corresponding to like numbered elements previously described with reference to FIGS. 9A–9B. In addition, an arcuate opening 182' is provided in the casing, permitting a connecting member associated with the handle mechanism of one pole to extend through adjacent casing walls to an adjacent pole. The arcuate form of opening 182' is designed to allow arcuate motion of the connecting member, as described below. A recess 188' on the interior wall of the casing receives an end of pivot pin 60, as seen in FIG. 2.

A recess 202 may be formed in the exterior wall of the casing surrounding opening 182' as an element of the alternate embodiment of the present invention that is discussed below. A pin 196 extends from the wall in the vicinity of opening 182'. It should be understood that, while the opposite casing half (not shown) is substantially a mirror image of that illustrated in FIGS. 10A–10B, and includes a recess 202 in the alternate embodiment the other half need not include pin 196. The casing also includes an opening 174', to permit additional connecting members to pass between adjacent poles.

Figure 11A:
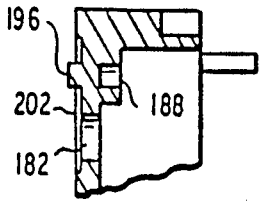
FIG. 11A is a part sectional view of another casing configuration used in a multipole versions of the invention taken along the line A—A of FIG. 11B.
Figure 11B:
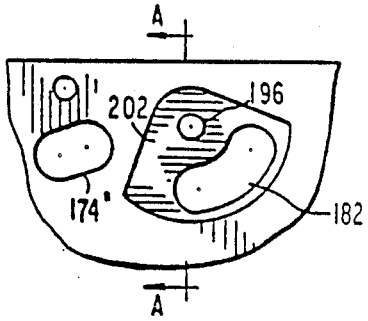
FIG. 11B is a partial side view of the casing of FIG. 11A.

FIGS. 11A and 11B illustrate a second form of casing in accordance with the alternate embodiment of the present invention. This embodiment is similar to that illustrated in FIGS. 10A and 10B, except that it is adapted for use in a breaker pole having a handle link (see FIGS. 15A–15B and related discussion below). Parts shown in FIGS. 11A and 11B corresponding to those of FIGS. 10A and 10B are similarly numbered Boss 22', recess 140' and ridge 142' are unnecessary in this form of the casing, as there is no handle portion which extends from the casing nor is there any access to the interior of the housing in this region.

FIGS. 12A and 12B illustrate a shield, or covering means 190, which may be interposed in the space defined by recesses 202 in adjacent pole casings in a multipole breaker in accordance with the alternate embodiment of the invention. FIG. 12A depicts the position of shield 190 and a connecting member 180 when the circuit breaker is in its closed or ON condition; FIG. 12B shows the same elements when the breaker is opened. Phantom line 34 indicates the position of frame 34 within the casing.

Shield 190 also includes an arcuate slot 198, the center of radius of which substantially coincides with the center of opening 192. Arcuate slot 198 has a width sufficient to permit extension 180 to pass therethrough. Slot 198 in shield 190 and slot 182 in the casing cooperate to define a tortuous path. Together, they serve to maintain a sufficient effective distance between conductive parts of adjacent poles to meet industry safety standards.

Figure 14:
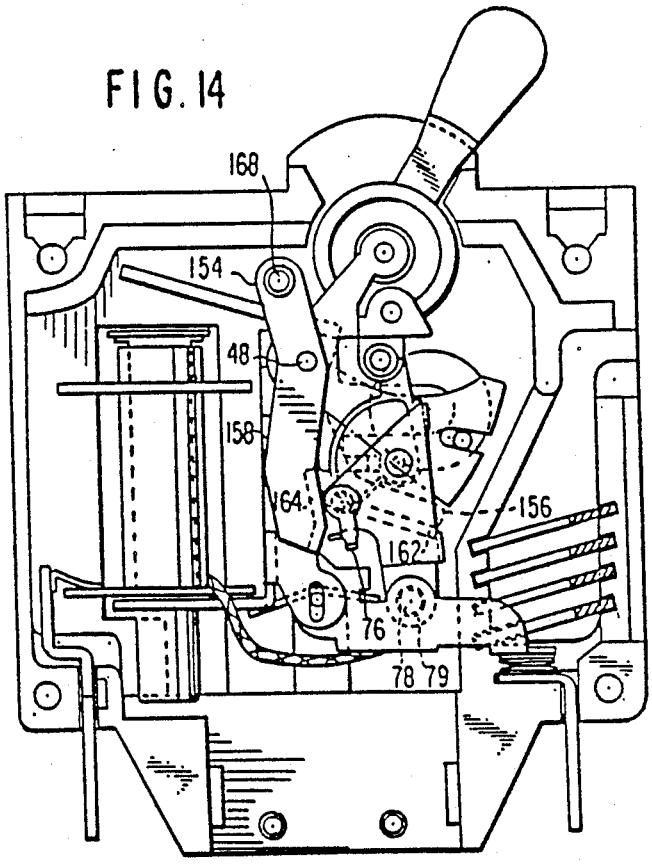
FIG. 14 is a side view of a circuit breaker of the present invention including the trip lever illustrated in FIGS. 13A and 13B.

FIGS. 13A–13B illustrate an improved trip lever 154 of the present invention; FIG. 14 shows the trip lever mounted in a breaker. Lever 154 includes a first leg 156 and a second leg 158. A connecting member 160 joins legs 156 and 158 at one end of each leg. A flange 162 at the other end of first leg 156 is adapted to be engaged by enlarged end 79 on rivet 78 (see FIGS. 2 and 14) which connects housing link 72 to movable contact arm 80. A flange 164 on the other end of second leg 158 is adapted to strike sear striker bar 76. Connecting portion 160 includes a tapered aperture 166 therein, shown partly in section in FIG. 13A. The internal diameter of aperture 166 decreases toward its innermost portion. A complementary tapered extension 168 extends from connecting portion 160. The diameter of extension 168 decreases toward its outer endmost portion. Aperture 166 and extension 168 have similar tapers, whereby an extension 168 of one trip lever may be easily inserted yet snugly seated within an aperture 166 of a similar adjacent trip lever for frictional engagement with the adjacent trip lever. Legs 156 and 158 include a pair of aligned apertures 170 and 172, respectively, for pivotally mounting lever 154 on pin 48 in frame 34, as illustrated in FIG. 14. A pair of recesses 173 and 175 in leg 158 accommodates a spring (not shown) which biases lever 154 in a clockwise direction as viewed in FIG. 14. The circuit breaker casing includes openings 174 (see FIGS. 9B. 10B, 11B) which permit an extension 168 of on breaker pole to project out from the pole casing and to extend into the housing of an adjacent breaker pole. Extension 168 of the last pole is simply cut off so as not to protrude from the device.

When so arranged, trip levers 154 of adjacent poles mate with each other by means of extensions 168 and apertures 166. When properly joined together, the outer surface of one tapered extension 168 mates snugly and securely with the similarly tapered inner surface of an adjacent aperture 166. The closely fitting levers will therefore all pivot essentially simultaneously, an improvement over known devices, in which manufacturing tolerances caused play in the mating mechanism. This resulted in compounded tripping delays from pole to pole.

If any pole of the multipole circuit breaker of the invention is tripped open by an overcurrent, upward motion of contact arm 80 will cause enlarged end 79 of rivet 78 (FIG. 14) to strike flange 162 of leg 156. This will cause the trip lever of the tripped pole to pivot about pin 48 in a counter clockwise direction (as shown in FIG. 14). The several trip levers, joined by the improved mating means 166, 168 of the present invention, will rotate similarly and substantially simultaneously. Flange 164 of each trip lever will strike respective sear striker bars 76 of the other, still closed, breaker poles. This will trip open each pole of the multipole circuit breaker.

The trip lever of the invention is a substantial improvement over similar known devices. First, as set forth above, tapered apertures 166 and tapered extensions 168 assure substantial alignment and simultaneous motion of all trip levers associated with all poles of the multipole circuit breaker. This results in essentially simultaneous tripping of all poles. Additionally, once rivet end 79 strikes flange 162 of a trip lever, the motion imparted to all trip levers is transferred directly to sear pin release means of each remaining pole. Thus, the complex and lengthy sequence of mechanical movements associated with known devices is eliminated and the time delay between the initial tripping of one pole and tripping open of all other poles will be substantially reduced.

A multipole circuit breaker in accordance with the present invention also includes an improved manual switching arrangement which will be discussed with reference to FIGS. 3A, 3B, 15A, 15B and 16.

Handle 26 (FIGS. 3A, 3B) includes a pair of oppositely extending lateral protrusions 100 having apertures 102 contained therein. These apertures, like apertures 166 of trip lever 154, are tapered, having an internal diameter which decreases toward the interior portion thereof.

FIGS. 15A and 15B illustrate a handle link 176 in accordance with the present invention. Handle link 176 is operatively similar to handle 26, but does not include a portion, e.g., like handle portion 27, which extends outwardly of the casing to permit manual operation of the breaker pole with which handle link 176 is associated. Movement of handle link 176 results from movement of handle 26 of an associated pole to which it is joined.

Handle link 176 is used in place of handle 26 in single handle multipole embodiments of the invention. Handle link 176 includes an opening 90' in a hub 91' (corresponding to similarly numbered parts of handle 26) for pivotally mounting handle link 176 on pin 60 of its associated pole. Ears 62' and 64' contain apertures 92' and 94', respectively. Rivet 66 passes through apertures 92' and 94' to join handle link 176 to cam link 68.

A pair of lateral protrusions **178*a*, 178*b* extends from opposite sides of handle link 176. Protrusions 178*a*, 178*b* are spaced from opening 90' a radial distance which corresponds to the radial distance between centers of aperture 102 and opening 90 of handle 26. A tapered extension portion 180 extends from one lateral protrusion 178*a*. The casing of the breaker of the invention includes arcuate opening 182 (FIG. 9) which permit extensions 180** to extend into the casings of adjacent poles.

When the poles of the multipole circuit breaker are arranged adjacent each other, an extension 180 of a breaker pole will seat snugly in a friction fit arrangement within aperture 102 of the pole containing handle 26. Thus, when handle 26 is pivoted about its axis, all handle links joined thereto will also pivot, whereby each pole will be substantially simultaneously opened or closed. The precise fit of extensions 180 within apertures 102, in like manner as described above with respect to apertures 166 and extensions 168, assures essentially simultaneous movement of all breakers and substantially reduces the time lag between opening or closing of respective breaker poles associated with known multipole circuit breakers.

In order to eliminate disadvantageous lag times in the manual activation of multipole breaker units it may be necessary to limit the number of breaker poles that are joined in a multipole assembly. Although two breakers may be essentially simultaneously controlled by a single throw joining their respective handle mechanisms, even the use of handle link mechanisms of the present invention may not eliminate all delays in breaker activation when more than four-breaker multipole assemblies are used. Thus, for example, in a four-breaker multipole assembly of the present invention, the two central breaker poles are activated by externally connected toggle handles 26 and the two outside breakers are joined to the inner breakers via handle links 176 described above and their respective tapered portions 180.

Figure 16:
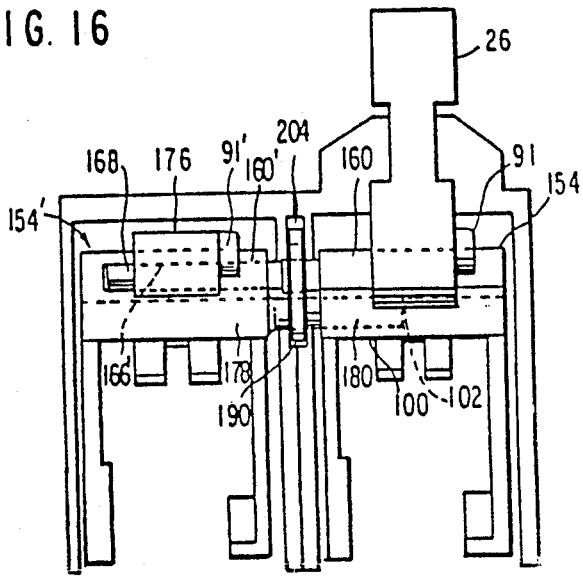
FIG. 16 illustrates selected elements of adjacent poles of a multipole circuit breaker in accordance with the invention, including adjacent casings, operating means, trip levers, and a shield between casings.

FIG. 16 illustrates adjacent poles of a multipole circuit breaker according to the invention and the manner in which the handle, handle link, and trip levers thereof are joined. Also illustrated in FIG. 16 is the manner in which shields 190 are utilized in the alternate embodiment. One pole includes handle 26 pivotally mounted by hub 91. Tapered recess 102,100 receives tapered extension 180 of handle link 176. Handle link 176 is mounted for pivotal movement about hub 91'. The tapered extension 168 of connecting member 160 of a first trip lever 154 is received in a tapered aperture 166' of another trip lever 154' associated with the other pole. Extensions 180 and 168 extend through openings 182 and 174, respectively, of the adjoining walls of the poles (see FIG. 9B). In the alternate embodiment (of FIG. 16), recesses 202 in adjoining walls together form a space 204 for receiving shield 190 therein (FIG. 16).

When the circuit breaker is manually switched to the OFF or open position, extension 180 travels in a counterclockwise direction about the axis of its pivot mount 60, coincident with the axis of pin 196, into the position illustrated in FIG. 12A. Once extension 180 has traversed the full length of arcuate slot 198, contact with the end portion 199 thereof rotates shield 190 in a counterclockwise direction, into the position illustrated in FIG. 12B.

Extensions 168 and 180, which mechanically link adjacent poles, are formed from non-conductive material, to thereby electrically isolate adjacent poles from each other. Typically, handle link 176 and handle 26 are formed entirely of molded, non-conductive plastic. Likewise, trip lever 154 is molded of non-conductive plastic material. In order to limit the overall dimensions of individual poles, and thus the entire multipole circuit breaker, shield 190 is used in the alternate embodiment to maintain adequate separation between electrically conductive portions of adjacent poles, so that they may be brought into closer proximity to each other than would otherwise be possible.

Thus, frame 34 is the electrically conductive element of each pole which, in the region of opening 182, is closest to the wall of the pole. The distance between frame members of adjacent poles through openings 182 is the shortest distance between electrically conductive parts of adjacent poles. For safety purposes, it is necessary that this distance be sufficient to prevent arcing between adjacent poles. The aforementioned VDE and IEC standards require at least 0.315 inch (8 mm) between conductive portions of adjacent breaker poles. In the preferred embodiment of the invention, the tortuous path of the casing, and its thickness about opening 182 provide the requisite distance between conductive elements of adjacent poles. Shield 190 in the alternate embodiment maintains the required distance between adjoining breakers in circuit breakers of minimum overall dimensions.

In the alternate embodiment, in the absence of shield 190, with extension 180 in the position illustrated in FIG. 12B, the effective distance between frames 34 of adjacent poles would be the straight line distance between the frames plus twice the distance L, where "L" is the distance between the closest proximate edges of frame 34 and opening 182'. Shield 190 increases the total effective distance between adjacent frames by increasing the distance between the edge of frame 34 and the casing opening. As shown in FIG. 12B, "L" represents the distance between the edge of casing opening 182' and shield opening 198 when the breaker is in the OFF position. With extension 180 and shield 190 in the positions shown in FIG. 12B, the effective distance between adjacent frames 34 is the straight line distance therebetween plus twice the distance (L+L'), where (L+L') is the distance between the closest proximate edges of frame 34 and arcuate slot 198. Therefore, shield 190 increases the effective distance between frames 34 of adjacent poles by an amount equal to 2L'. This increased distance facilitates maintenance of adequate separation between adjoining frames in circuit breakers of smaller dimensions than was heretofore possible.

While the reference has been made to frames 34 as the conductive elements which are closest to each other, it should be understood that, if the particular arrangement of elements differs from that illustrated and other conductive elements are closer to an opening such as 182, the minimal distance between adjoining ones of such other conductive elements would be of primary concern.

While the invention, in its various aspects, has been described with reference to the accompanying figures, it should be understood that the invention is not limited to the details shown in the figures, the invention being limited only by the claims appended hereto.

I claim as my invention:

1. A circuit breaker, comprising:

a non-conductive casing, a plurality of electrically conductive elements within said casing, and a non-conductive handle for manipulating at least some of said electrically conductive elements;

means for pivotably mounting said handle in said casing for movement about a defined pivot axis;

said handle comprising a first portion which extends out of said casing for grasping by an operator, a second portion contained within said casing and containing said pivot axis, and an intermediate handle portion connecting said first and second handle portions;

said intermediate handle portion having a narrowed cross-sectional width relative to the cross-sectional width of said first handle portion to define a bridging surface extending between the face of said intermediate handle portion and the lateral outer surface of said first handle portion;

said second handle portion being shaped to define a combination of at least one ridge and at least one recess disposed radially outwardly of said pivot axis which together form a non-planar surface configuration;

said casing having an outer surface portion which cooperates with said bridging surface to define a first part of a tortuous path between the exterior and interior of said casing;

said casing further having a wall portion disposed radially outwardly of said pivot axis and extending adjacent to and facing said intermediate handle portion, the lateral outer surface of said first handle portion extending laterally outwardly of said casing wall portion, such that said facing case wall and intermediate handle portions together define a second part of said tortuous path; and said casing further comprising a combination of at least one recess and at least one ridge disposed radially outwardly of said pivot axis which form a non-planar surface configuration adjacent and complementary to said non-planar surface configuration of said second handle portion to define a third part of said tortuous path.

2. A circuit breaker according to claim 1, wherein said non-planar surfaces of said handle and casing are spaced from each other to form gaps of substantially uniform width which define said tortuous path.

3. A circuit breaker according to claim 2, wherein said tortuous path is substantially S-shaped in cross-section.

4. A circuit breaker according to claim 2, wherein said handle is movable relative to said casing in a direction substantially parallel to at least a portion of each of said non-planar surfaces.

5. A circuit breaker according to claim 4, wherein said handle is pivotable relative to said casing.

6. A circuit breaker according to claim 5, wherein said ridges and recesses of said handle and casing are arcuately shaped, with their centers of radii substantially coincident with the pivot axis of said handle.

7. A circuit breaker according to claim 1, wherein said second handle portion has non-planar surface configurations on opposite surfaces; and said casing comprises two complementary housing portions, each having a non-planar surface configuration which cooperates with a corresponding one of said second handle portion non-planar surface configurations to define a said tortuous path.

8. A circuit breaker according to claim 7, wherein said non-planar surfaces of said handle and casing are spaced from each other to form a gap of substantially uniform width which defines said tortuous path.

9. A circuit breaker according to claim 8, wherein said handle is pivotable relative to said casing and said ridges and recesses, and said ridges and recesses of said handle and casing are arcuately shaped, with their centers of radii substantially coincident with the pivot axis of said handle.

10. A circuit breaker according to claim 1, wherein said casing comprises two complementary housing portions having non-planar surface configurations which cooperate with said non-planar handle surface configuration, said housing portions having bosses with inwardly extending portions which mate, in spaced apart relation, with said narrowed width intermediate handle portion to define extensions of said tortuous path.

11. A circuit breaker according to claim 10, wherein the distance from said exposed portion of said handle through said tortuous path to any of said electrically conductive elements is at least 0.315 inch.

12. A circuit breaker according to claim 10, wherein: said electrically conductive elements include a frame member, and a pin member supported by said frame member; said second handle portion is mounted to said pin member for pivotal movement relative to said frame member; and the minimum distance from said exposed portion of said handle through said tortuous path to said frame member is at least equal to industry safety standards.

13. A circuit breaker according to claim 12, wherein: said non-planar handle surface configuration comprises at least one arcuate ridge and at least one arcuate recess; said nonplanar surfaces of said casing comprise at least one arcuate recess and at least one arcuate ridge; the arcs of said ridges and recesses of said handle and casing being centered on the pivot axis of said handle.

14. The circuit breaker of claim 1, wherein:

said intermediate portion of said handle is narrower than the radially outermost portion of said handle portion to define a second bridging surface between said intermediate portion and said second portion.

15. The circuit breaker of claim 1, wherein:

said handle and said casing are generally symmetric about a plane perpendicular to said pivot axis.

16. The circuit breaker of claim 1, wherein:

said casing outer surface portion is arcuately shaped.

* * * * *